US006125500A

United States Patent [19]

Kat

[11] Patent Number: 6,125,500

[45] Date of Patent: Oct. 3, 2000

[54] COMBINATION SWING BROOM AND VACUUM CLEANER ASSEMBLY

[76] Inventor: Niels Kat, 5955 Abroath Avenue, Burnaby, BC, Canada, V5J 1P2

[21] Appl. No.: 09/108,460

[22] Filed: Jul. 1, 1998

Related U.S. Application Data

[63] Continuation-in-part of application No. 08/698,494, Jul. 5, 1996, abandoned.

[51] Int. Cl.[7] ..... A47L 5/24

[52] U.S. Cl. ..... 15/344; 15/350; 15/354; 15/398; 15/410

[58] Field of Search ..... 15/339, 344, 350, 15/398, 410

[56] References Cited

U.S. PATENT DOCUMENTS

| | | | |
|---|---|---|---|
| 4,715,084 | 12/1987 | Jacob et al. | 15/410 X |
| 4,884,514 | 12/1989 | Miner et al. | 15/410 X |
| 5,054,159 | 10/1991 | Richardson | 15/398 X |
| 5,432,976 | 7/1995 | Alazet | 15/398 X |
| 5,440,782 | 8/1995 | Yamashita | 15/398 |
| 5,603,139 | 2/1997 | Alazet | 15/350 X |
| 5,617,610 | 4/1997 | Dearaujo | 15/350 X |
| 5,638,572 | 6/1997 | Ferrari | 15/350 X |
| 5,722,112 | 3/1998 | Scanni et al. | 15/344 |
| 5,839,158 | 11/1998 | Schupp et al. | 15/344 X |
| 5,850,669 | 12/1998 | Schupp et al. | 15/350 X |

*Primary Examiner*—Chris K. Moore

[57] ABSTRACT

A new Combination Broom and Vacuum Cleaner Assembly for easy pickup of dirt piles. The inventive device includes an upper handle, a lower handle, a broom portion, a means for creating suction, a vacuum manifold, and an attachment head. In use, the Combination Broom and Vacuum Cleaner Assembly is used to sweep up dirt and the like using the broom portion. After gathering the debris up into a pile, the vacuum manifold is lowered and used to pickup the pile easily and swiftly. After picking up the pile of debris, the vacuum manifold is again raised to enable sweeping once again.

8 Claims, 3 Drawing Sheets

16
10
4
70
24
47
33
24
36
36
34
26
48
28
28
38
38
27
27
49
35
35
44
4
22

46
56
16
70
17
10
72
24
31
33
39
45

42
41
43
34
44
32
27
49
35
22

COMBINATION SWING BROOM AND VACUUM CLEANER ASSEMBLY

CROSS REFERENCE TO RELATED APPLICATION

This application is a continuation-in-part of application Ser. No. 08/698,494, filed Jul. 5, 1996, now abandoned.

BACKGROUND OF THE INVENTION

1. Field of the Invention

The present invention relates to brooms and more particularly pertains to a new Combination Broom and Vacuum Cleaner Assembly for easy pickup of dirt piles.

2. Description of the Prior Art

The use of brooms is known in the prior art. More specifically, brooms heretofore devised and utilized are known to consist basically of familiar, expected and obvious structural configurations, notwithstanding the myriad of designs encompassed by the crowded prior art which have been developed for the fulfillment of countless objectives and requirements.

Known prior art brooms include U.S. Pat. No. 5,432,976; U.S. Pat. No. 4,665,582; U.S. Pat. No. Des. 317,678; U.S. Pat. No. 5,337,443; U.S. Pat. No. 4,989,292; U.S. Pat. No. 4,841,594; U.S. Pat. No. 5,722,112; U.S. Pat. No. 4,715,084; U.S. Pat. No. 4,884,314; U.S. Pat. No. 5,054,159; U.S. Pat. No. 5,440,782; U.S. Pat. No. 5,603,139; U.S. Pat. No. 5,617,610; and U.S. Pat. No. 5,638,572.

While these devices fulfill their respective, particular objectives and requirements, the aforementioned patents do not disclose a new Combination Broom and Vacuum Cleaner Assembly. The inventive device includes an upper handle, a lower handle, a broom portion, a means for creating suction, a vacuum manifold, and an attachment head.

In these respects, the Combination Broom and Vacuum Cleaner Assembly according to the present invention substantially departs from the conventional concepts and designs of the prior art, and in so doing provides an apparatus primarily developed for the purpose of easy pickup of dirt piles.

SUMMARY OF THE INVENTION

In view of the foregoing disadvantages inherent in the known types of brooms now present in the prior art, the present invention provides a new Combination Broom and Vacuum Cleaner Assembly construction wherein the same can be utilized for easy pickup of dirt piles.

The general purpose of the present invention, which will be described subsequently in greater detail, is to provide a new Combination Broom and Vacuum Cleaner Assembly apparatus and method which has many of the advantages of the brooms mentioned heretofore and many novel features that result in a new Combination Broom and Vacuum Cleaner Assembly which is not anticipated, rendered obvious, suggested, or even implied by any of the prior art brooms, either alone or in any combination thereof.

To attain this, the present invention generally comprises an upper handle, a lower handle, a broom portion, a means for creating suction, a vacuum manifold, and an attachment head.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new Combination Broom and Vacuum Cleaner Assembly apparatus and method which has many of the advantages of the brooms mentioned heretofore and many novel features that result in a new Combination Broom and Vacuum Cleaner Assembly which is not anticipated, rendered obvious, suggested, or even implied by any of the prior art brooms, either alone or in any combination thereof.

It is another object of the present invention to provide a new Combination Broom and Vacuum Cleaner Assembly which may be easily and efficiently manufactured and marketed.

It is a further object of the present invention to provide a new Combination Broom and Vacuum Cleaner Assembly which is of a durable and reliable construction.

An even further object of the present invention is to provide a new Combination Broom and Vacuum Cleaner Assembly which is susceptible of a low cost of manufacture with regard to both materials and labor, and which accordingly is then susceptible of low prices of sale to the consuming public, thereby making such Combination Broom and Vacuum Cleaner Assembly economically available to the buying public.

Still yet another object of the present invention is to provide a new Combination Broom and Vacuum Cleaner Assembly which provides in the apparatuses and methods of the prior art some of the advantages thereof, while simultaneously overcoming some of the disadvantages normally associated therewith.

Still another object of the present invention is to provide a new Combination Broom and Vacuum Cleaner Assembly for easy pickup of dirt piles.

Yet another object of the present invention is to provide a new Combination Broom and Vacuum Cleaner Assembly which includes an upper handle, a lower handle, a broom portion, a means for creating suction, a vacuum manifold, and an attachment head.

Still yet another object of the present invention is to provide a new Combination Broom and Vacuum Cleaner Assembly that is light in weight and can be used without tiring the arms of the user.

Even still another object of the present invention is to provide a new Combination Broom and Vacuum Cleaner Assembly that can pickup a pile of dirt after gathering the dirt up into a pile.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
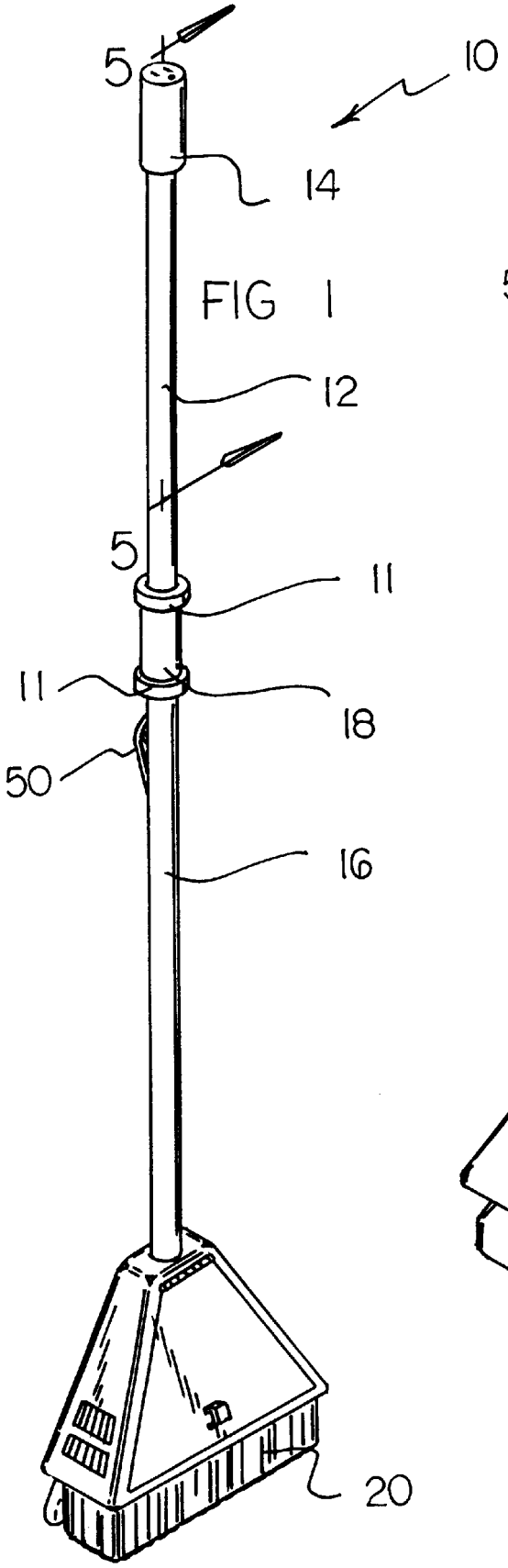
FIG. 1 is a front side perspective view of a new Combination Broom and Vacuum Cleaner Assembly according to the present invention.
Figure 2:
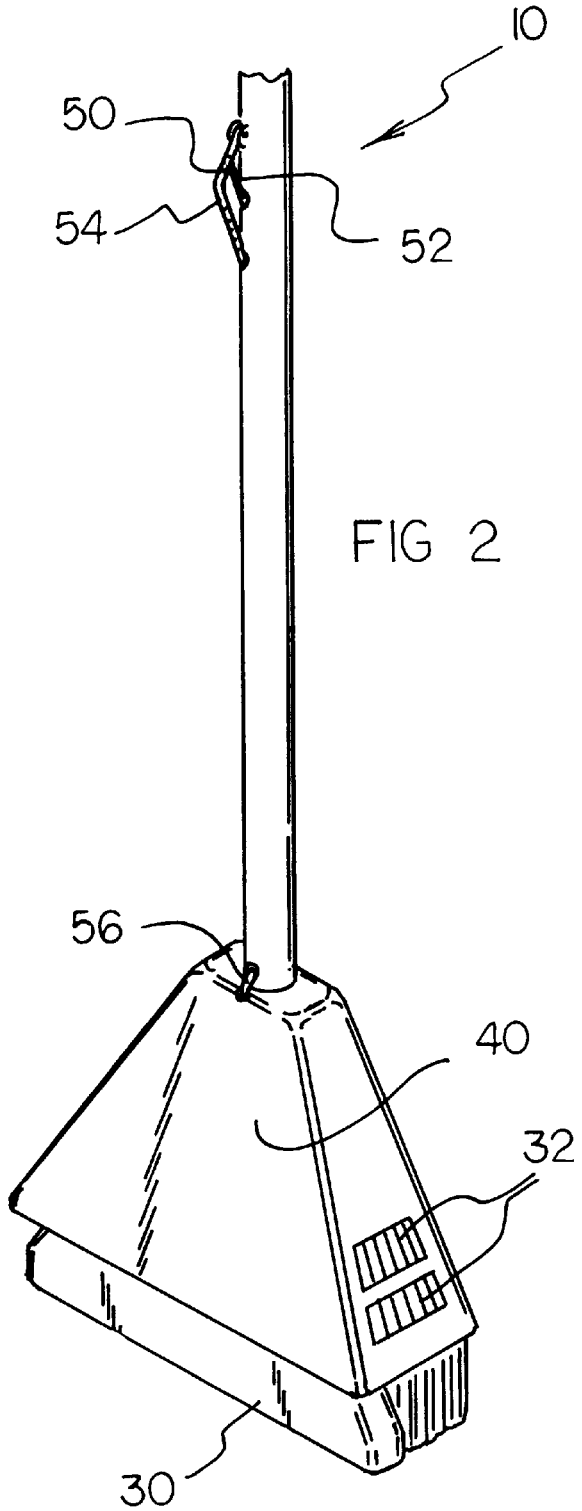
FIG. 2 is an enlarged rear side perspective view of a new Combination Broom and Vacuum Cleaner Assembly according to the present invention.

With reference now to the drawings, and in particular to FIGS. 1 through 6 thereof, a new Combination Broom and Vacuum Cleaner Assembly embodying the principles and concepts of the present invention and generally designated by the reference numeral 10 will be described.

More specifically, it will be noted that the Combination Broom and Vacuum Cleaner Assembly 10 comprises an upper handle 12, a lower handle 16, a broom portion 20, a vacuum manifold 35, a means for creating suction 30 through the vacuum manifold, and an attachment head 40.

As best illustrated in FIGS. 1 through 6, it can be shown that the upper handle 12 and the lower handle 16 are joined together substantially at a lower handle grip 18. The lower handle 16 is fixedly attached by virtue of a handle flange 17 at a lower end of the lower handle 16 to a head flange 46 of the attachment head 40 which houses both the broom portion 20 and the a means for creating suction 30. The lower handle grip 18 further includes lower handle flanges 11.

The broom portion 20 comprises broom bristles 22 which protrude and extend from a bristle base 49 which is further defined as a rib around the bottom end of the attachment head 40. The bristle base 49 is secured to the attachment head 40 and the center wall 43 such that the bristle base 49 seals the lower end of the forward side of the attachment head 40. A base channel 27 is defined between the bristle base 49 and the bottom wall 44.

The attachment head 40 is substantially hollow and includes a front wall 41, a back wall 42, a center wall 43, a left side 47, a right side 48, and a bottom wall 44, where the bottom wall 44 is disposed above and lies in a plane parallel to a plane of the bristle base 49.

Figure 3:
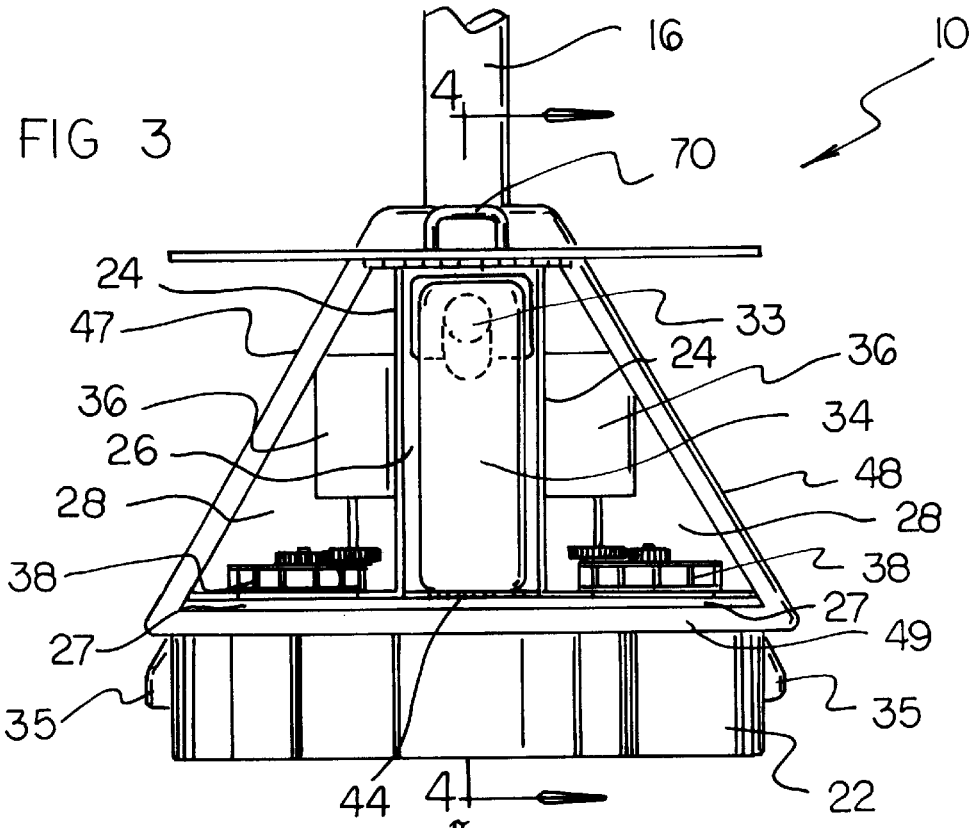
FIG. 3 is an enlarged, detailed, rear, cutaway, elevation view of the present invention.
Figure 4:
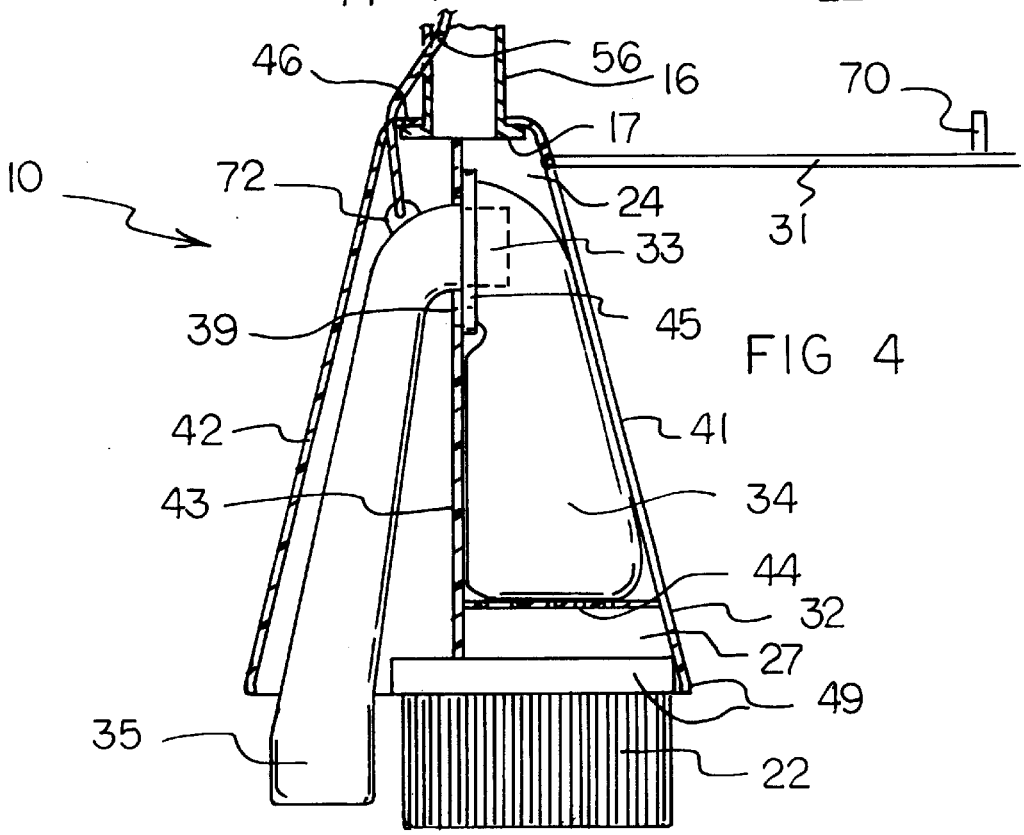
FIG. 4 is a cross sectional view taken along line 4—4 of FIG. 3.

The attachment head 40 further has two motor compartments 28, best shown in FIG. 3. Each motor compartment 28 is formed by a front wall 41, a respective side wall 47 or 48, a center wall 43, a respective support wall 24, and a bottom wall 44. An air bag channel 25 is formed between the support walls 24. The air bag channel 26 leads through an aperture in bottom wall 44 to base channel 27 such that air bag channel 26 and base channel 27 are in fluid communication with each other.

Center wall 43 includes a travel slot 39 through which suction tube 33 is inserted. Air bag 34 is positioned within the forward side of the attachment head and is removably secured to suction tube 33 by bag head 45. Air bag 34 is constructed of a material such that air drawn through air bag 34 is filtered by the material of air bag 34.

Vacuum motors 36 and vacuum fans 38 are positioned within the motor compartments 28. Each vacuum fan 38 is positioned to draw air through a plurality of holes in bottom wall 44 into a respective motor compartment 28. Suction is created by the vacuum fans 38 such that air is drawn through vacuum manifold 35, through suction tube 33, into air bag 34, through air bag 34 into air bag channel 26, and down into base channel 27. Air drawn from base channel 27 through bottom wall 44 and into motor compartments 28 is dispelled through air vents 32 positioned in either left side 47 or right side 48.

The vacuum manifold 35 protrudes out from within the attachment head 40 and is vertically positionable using lift linkage 56. Lift linkage 56 attaches to the vacuum manifold 35 proximate to suction tube 33. Lift linkage 56 runs upwardly through head attachment 40 and into lower handle 16. Lift linkage 56 is secured at an upper end to lever setting retainer 54 which is pivotally connected to lower handle 16 using a hinge. Control lever 52 is disposed from lever setting retainer 54 such that an end of control lever 52 can be engaged to a notch in lower handle 16. In the engaged position control lever 52 props up lever setting retainer 54, thus lifting the vacuum manifold 35, suction tube 33, air bag 34, and bag head 45.

Front wall 41 includes a door 31 having a handle 70. Door 31 provides access to motors 36, vacuum fans 38, base channel 27 and air bag channel 26.

Figure 5:
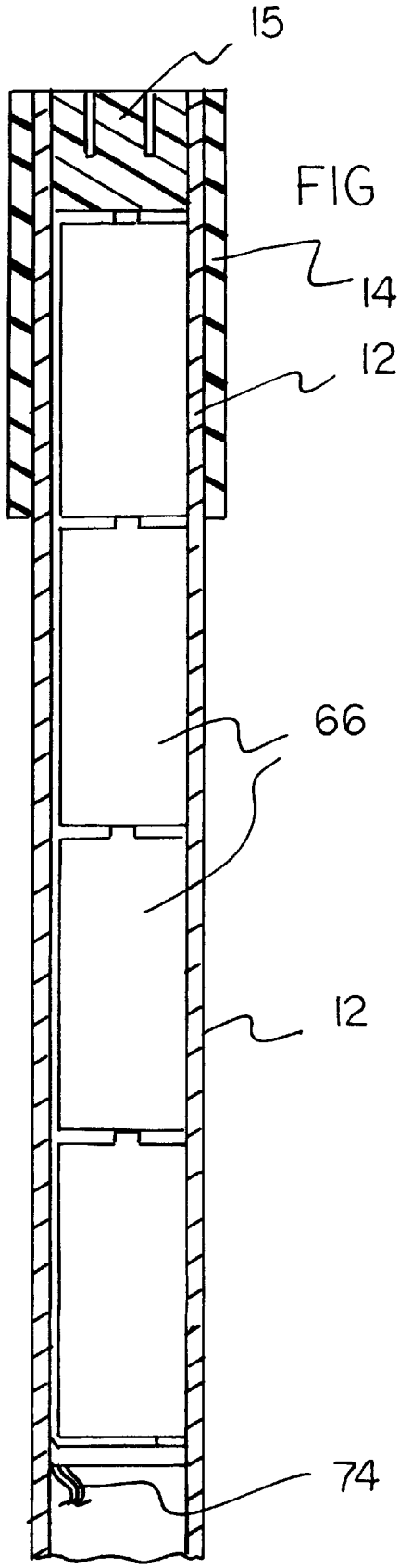
FIG. 5 is a cross sectional view taken along line 5—5 of FIG. 1.
Figure 6:
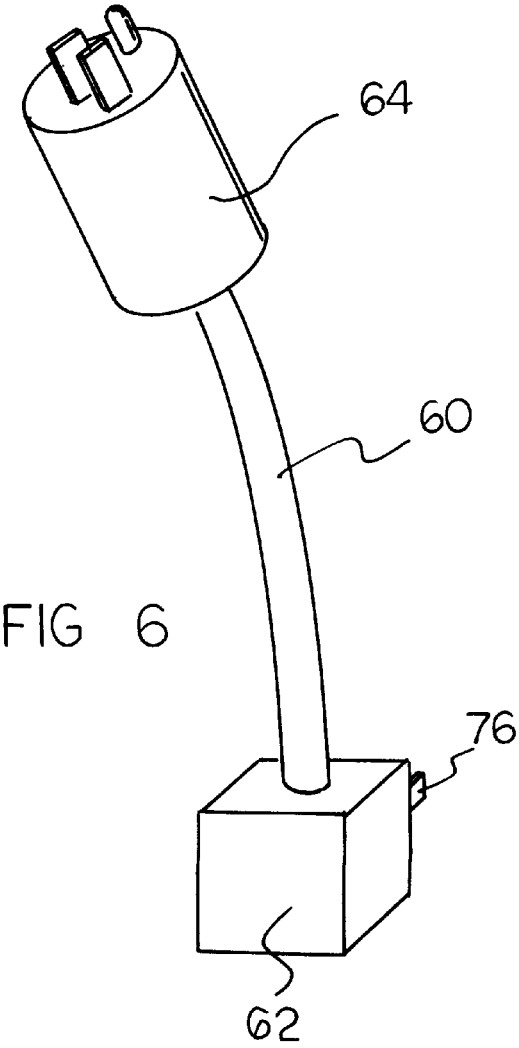
FIG. 6 is an enlarged detailed perspective view a power recharge adapter cord of the present invention.

Referring to FIGS. 5 and 6, the upper handle 12 further comprises an upper handle grip 14 and a female retainer plug 15, where the female retainer plug 15 electrically retains dry cell batteries 66 and matingly receives a low voltage male plug 76 of a power transformer 62. The low voltage male plug 76 is an extension protrusion of the power transformer 62 and the power transformer 62 is electrically connected by a power recharge adapter cord 60 to a male power plug 64.

The dry cell batteries 66 electrically put out electrical energy to the vacuum motors 36 by transferring the electrical energy by way of low voltage wiring 74. The power transformer 62 transforms the electrical energy from high voltage alternating current to low voltage direct current.

In use, the Combination Broom and Vacuum Cleaner Assembly 10 is used to sweep up dirt and the like using the broom 20. After gathering the debris up into a pile, the means for creating suction 30 is used to pickup the pile easily and swiftly.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A combination broom and vacuum cleaner assembly comprising:

an upper handle;

a lower handle coupled to the upper handle;

an attachment head coupled to a lower end of the lower handle, the attachment head being substantially hollow;

a broom portion protruding out from a lower end of the attachment head;

a vacuum manifold protruding out from within the attachment head; and a means for creating suction through the vacuum manifold.

2. The combination broom and vacuum cleaner assembly of claim 1 further comprising:

a center wall extending downwardly within the attachment head such that the vacuum manifold protrudes from a rearward side of the attachment head and the broom portion protrudes from a forward side of the attachment head.

3. The combination broom and vacuum cleaner assembly of claim 2, further comprising:

the center wall structured to have a travel slot therein;

a suction tube extending upwardly from the vacuum manifold and through the travel slot; and an air bag positioned within the forward side of the attachment head, the air bag removably coupled to the suction tube.

4. The combination broom and vacuum cleaner assembly of claim 3, wherein the means for creating suction through the vacuum manifold includes a pair of motors, each motor positioned within a motor compartment, each motor compartment positioned alongside the air bag to form an air bag channel.

5. The combination broom and vacuum cleaner assembly of claim 4, wherein the broom portion comprises a plurality of bristles and a bristle base;

the bristle base being secured to the attachment head and the center wall such that the bristle base seals the lower end of the forward side of the attachment head.

6. The combination broom and vacuum cleaner assembly of claim 5, wherein the bristle base and the motor compartments define a base channel in fluid communication with the air bag channel.

7. The combination broom and vacuum cleaner assembly of claim 6, wherein the means for creating suction in the vacuum manifold further comprises:

a pair of vacuum fans, each fan positioned within a respective motor compartment, each vacuum fan positioned such that upon activation the respective fan draws air from the base channel through apertures in a bottom wall of the respective motor compartments, whereby air is drawn into the vacuum manifold, through the suction tube, into the air bag, through the air bag, into the air bag channel, and then into the base channel; and a number of air vents positioned in the attachment head such that air drawn into the motor compartments by the vacuum fans is dispelled through the air vents.

8. A combination broom and vacuum cleaner assembly comprising:

an upper handle;

a lower handle coupled to the upper handle, said lower handle being hollow;

an attachment head coupled to a lower end of the lower handle, the attachment head being substantially hollow;

a vacuum manifold protruding out from within the attachment head;

a broom portion protruding out from a lower end of the attachment head;

a center wall extending downwardly within the attachment head such that the vacuum manifold protrudes from a rearward side of the attachment head and the broom portion protrudes from a forward side of the attachment head;

the center wall being structured to have a travel slot therein;

wherein the broom portion comprises a plurality of bristles and a bristle base;

the bristle base being secured to the attachment head and the center wall such that the bristle base seals the lower end of the forward side of the attachment head;

a suction tube extending upwardly from the vacuum manifold and through the travel slot;

an air bag positioned within the forward side of the attachment head, the air bag removably coupled to the suction tube;

a means for creating suction through the vacuum manifold;

wherein the means for creating suction through the vacuum manifold includes a pair of motors, a pair of vacuum fans, and a number of air vents;

each motor positioned within a motor compartment, each motor compartment positioned alongside the air bag to form an air bag channel;

wherein the bristle base and the motor compartments define a base channel in fluid communication with the air bag channel;

each fan positioned with in a respective motor compartment, each vacuum fan positioned such that upon activation the respective fan draws air from the base channel through apertures in a bottom wall of the respective motor compartments, whereby air is drawn into the vacuum manifold, through the suction tube, into the air bag, through the air bag, into the air bag channel, and then into the base channel; and the air vents being positioned in the attachment head such that air drawn into the motor compartments by the vacuum fans is dispelled through the air vents.

* * * * *